US009620010B2

(12) United States Patent
Grauer et al.

(10) Patent No.: US 9,620,010 B2
(45) Date of Patent: Apr. 11, 2017

(54) SIMULTANEOUSLY ILLUMINATING TRAFFIC LIGHT SIGNALS AT DIFFERENT RANGES

(71) Applicant: BRIGHTWAY VISION LTD., Haifa (IL)

(72) Inventors: Yoav Grauer, Haifa (IL); Ofer David, Haifa (IL); Eyal Levi, Haifa (IL); Ya'ara David, Kiryat Tiv'on (IL); Haim Garten, Haifa (IL); Alon Krelboim, Haifa (IL); Sharon Lifshits, Haifa (IL); Oren Sheich, Yoqneam (IL); Yan Katz, Petach Tikva (IL)

(73) Assignee: BRIGHTWAY VISION LTD., Haifa (IL)

( * ) Notice: Subject to any disclaimer, the term of this patent is extended or adjusted under 35 U.S.C. 154(b) by 0 days.

(21) Appl. No.: 14/422,359

(22) PCT Filed: Aug. 21, 2013

(86) PCT No.: PCT/IL2013/050711
§ 371 (c)(1),
(2) Date: Feb. 19, 2015

(87) PCT Pub. No.: WO2014/030164
PCT Pub. Date: Feb. 27, 2014

(65) Prior Publication Data

US 2015/0228189 A1 Aug. 13, 2015

Related U.S. Application Data

(60) Provisional application No. 61/691,442, filed on Aug. 21, 2012.

(51) Int. Cl.

| | |
|---|---|
| ***G08G 1/081*** | (2006.01) |
| ***G08G 1/095*** | (2006.01) |
| ***G08G 1/07*** | (2006.01) |

(52) U.S. Cl.
CPC ..... *G08G 1/081* (2013.01); *G08G 1/07* (2013.01); *G08G 1/095* (2013.01)

(58) Field of Classification Search
CPC ..... G08G 1/095; G08G 1/08; G08G 1/07
See application file for complete search history.

(56) References Cited

U.S. PATENT DOCUMENTS 6,268,805 B1 7/2001 Simon
6,317,058 B1 * 11/2001 Lemelson ..... G08G 1/07 340/905

(Continued)

FOREIGN PATENT DOCUMENTS

KR 20120096805 8/2012

OTHER PUBLICATIONS

International Search Report of International Application No. PCT/IL2013/050711 mailed on Dec. 5, 2013.

(Continued)

*Primary Examiner* — Hongmin Fan
(74) *Attorney, Agent, or Firm* — Pearl Cohen Zedek Latzer Baratz LLP

(57) ABSTRACT

A method of controlling a traffic light having at least two distinguishable light signals is provided herein. The method may include the following steps: obtaining a lighting pattern that determines an order of turning "on" and turning "off" said light signals over time; and illuminating the light signals based on the lighting pattern, such that over at least one period of time, a first light of the at least two distinguishable light signals is visible from a first distance range from the traffic light and a second light of the at least two distinguishable light signals is visible from a second distance range from the traffic light, wherein the first and the second distance ranges are non-overlapping.

20 Claims, 6 Drawing Sheets

(56) References Cited

U.S. PATENT DOCUMENTS

| | | | | |
|---|---|---|---|---|
| 6,473,002 | B1 * | 10/2002 | Hutchison | G08G 1/095 340/815.4 |
| 6,970,296 | B2 | 11/2005 | Blumel | |
| 7,147,400 | B2 | 12/2006 | Van Der Poel | |
| 7,330,130 | B2 | 2/2008 | Bolotin et al. | |
| 2005/0220538 | A1 * | 10/2005 | Van Der Poel | E01F 9/085 404/14 |

OTHER PUBLICATIONS

Office Action of Chinese Patent Application No. 2013800442674, mailed on Mar. 23, 2016.

* cited by examiner

SIMULTANEOUSLY ILLUMINATING TRAFFIC LIGHT SIGNALS AT DIFFERENT RANGES

CROSS-REFERENCE TO RELATED APPLICATIONS

This application is a National Phase Application of PCT International Application No. PCT/IL2013/050711, International Filing Date Aug. 21, 2013, claiming priority of U.S. Patent Application No. 61/691,442, filed Aug. 21, 2012, which is hereby incorporated by reference.

BACKGROUND

1. Technical Field

The present invention relates to method and device adapted to improve and aid driving of vehicles by users, as well as, improves traffic flow.

2. Discussion of Related Art

The present invention relates to traffic lights and traffic control and can be used on roads which have a traffic light for traffic control.

Traffic lights are well known and widely utilized. A standard traffic light is formed as a device in which successively a green signal is turned on, then a yellow (or orange/amber) signal is turned on, and then a red signal is turned on, to signal to pedestrians and motorists. While green signal is on it is allowed to proceed, while the red signal is on it is not allowed to proceed and while a yellow signal (following green signal or red signal) is desirable to change status (e.g. start proceeding or stop proceeding).

The yellow light is normally long enough to permit motorists either clear the intersection or stop before the intersection. If a motorist is very near the intersection when the yellow signal appears, he can probably cross the intersection at a normal traffic speed. If the motorist is some distance from the intersection at the beginning of the yellow light interval, a stop is in place.

A dilemma zone exists at a distance from the intersection whereat upon actuation of the yellow signal; the motorist could conceivably either stop before the intersection or proceed through it before the red light interval. Upon encountering a yellow signal in the dilemma zone, a motorist must decide in a few seconds or less whether to proceed or stop. The ability to stop or proceed on the yellow light is affected by the following in general casual, factors: the driver's reaction time; the vehicle's breaking performance; the speed of the vehicle; the vehicle acceleration performance; the road surface coefficient of friction (may be affected by weather); the proximity of following vehicle. All these factors must be quickly taken into account by the driver resulting in a decision if to stop prior intersection or to pass the intersection.

Another aspect may be an unevenly traffic flow control due to unexpected acceleration/deceleration of vehicles approaching intersection with traffic light indications due to traffic light signal transition. For example, A vehicle approaching an intersection with a traffic red light signal, at a distance of 100 m, may decrease its speed although the traffic light signal is about to change to a green signal.

Prior art presents a vast variety of traffic light devices. The industry has attempted to solve the problem by offering electronic devices, which work in association with conventional traffic light indicators by counting down the time remaining before the light change. U.S. Pat. No. 6,268,805 B1, titled "traffic light", where a digital color display indicates the remaining time until the traffic light signal is changing. Another example to this approach may be found in U.S. Pat. No. 7,330,130 B2, titled "apparatus for displaying the remaining time of a traffic light", where a programmable visual and pictorial display defined within the light indicators of the traffic light structure.

The industry has attempted to improve traffic light signal brightness by introducing different illumination devices such as LED and by introducing different optical systems in or on the traffic light such as described in U.S. Pat. No. 6,970,296 B2, titled "signaling device for traffic signals", where a device is presented for collimating a traffic signal by Fresnel optical system.

BRIEF SUMMARY

It is an object of the present invention to provide a traffic light that illuminates the light signals in different zones as a function of remaining time until a change is to occur in its state and as a function of predefined parameters comprising at least one: road allowed vehicle speed in the premises, actual vehicle speed (measured by a sensing unit such as a camera device), road layout, road condition, road topography, weather conditions, and traffic density.

It is also an important object of invention to provide a traffic light that automatically illuminates the lights signals (red, yellow and green) in different zones.

Another aspect of the invention is to provide a traffic light that is adaptable for use with variable time traffic lights.

Briefly, a traffic light with adaptive illuminating zones for use in the control of the flow of traffic that is constructed in accordance with the principles of the present invention has a controllable illumination fields.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
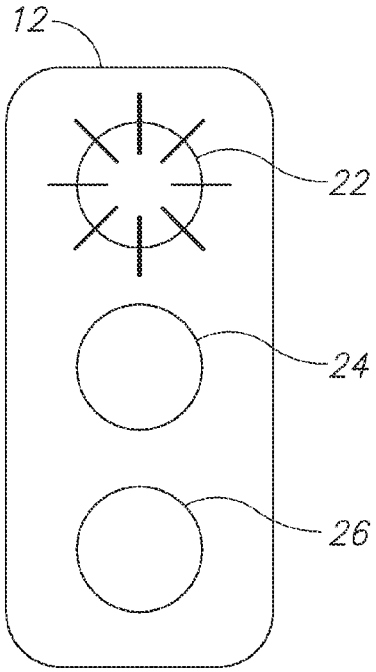
FIG. 1 is a front view of a traffic light in accordance with some embodiments of the present invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Although the following embodiments are describing an application in the field of transportation, namely a traffic light signaling system and method, the embodiments may be utilized in other application fields which have illumination patterns.

Generally, embodiments of the present invention provide a method of controlling a traffic light having at least two distinguishable light signals. The method may include the following steps: obtaining (possibly by a controller or a control center) a lighting pattern that determines an order of turning "on" and turning "off" said light signals over time; and illuminating (possibly by an array of range controlled illuminators) the light signals based on the lighting pattern, such that over at least one period of time, a first light of the at least two distinguishable light signals is visible from a first distance range from the traffic light and a second light of the at least two distinguishable light signals is visible from a second distance range from the traffic light, wherein the first and the second distance ranges are non-overlapping.

Referring now to the figures of the drawings in detail and first, FIG. 1 illustrates an adaptive traffic light 12 having three light signals; red 22, yellow 24 and green 26. For a traffic light user (pedestrian, motorists etc.) the adaptive traffic light 20 provides similar Human Machine interface (HMI) as a standard typical traffic light; red light signal 22 is presented in the upper part of the traffic light, yellow signal 24 is presented in the middle part of the traffic light and green signal 26 is presented in the lower part of the traffic light.

Figure 2:
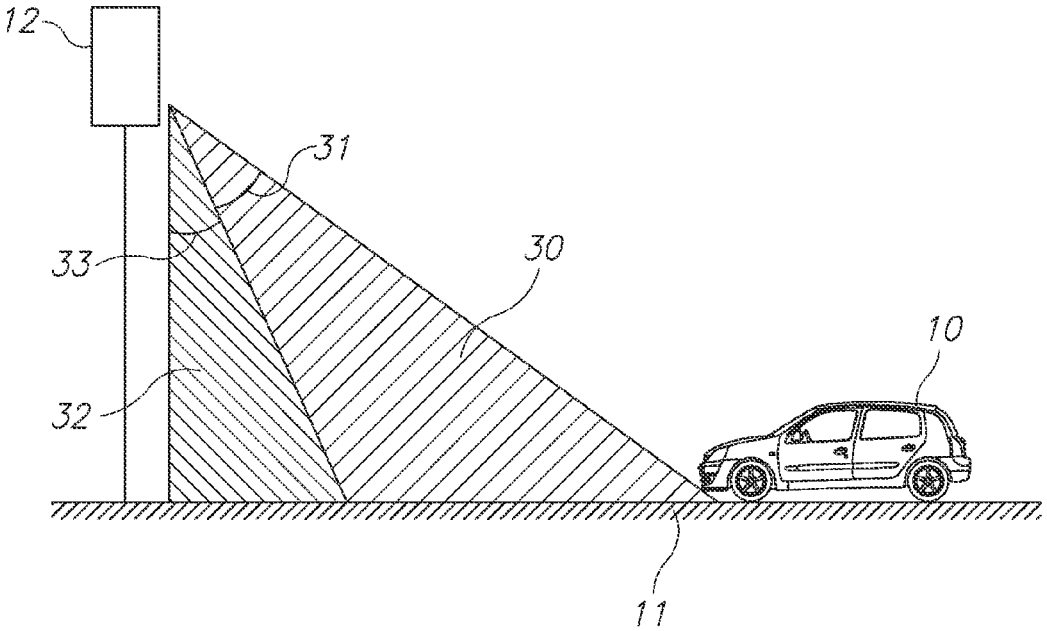
FIG. 2 is a side view of an adaptive traffic light with two different light signals' field of illumination in accordance with some embodiments of the present invention.
Figure 3:
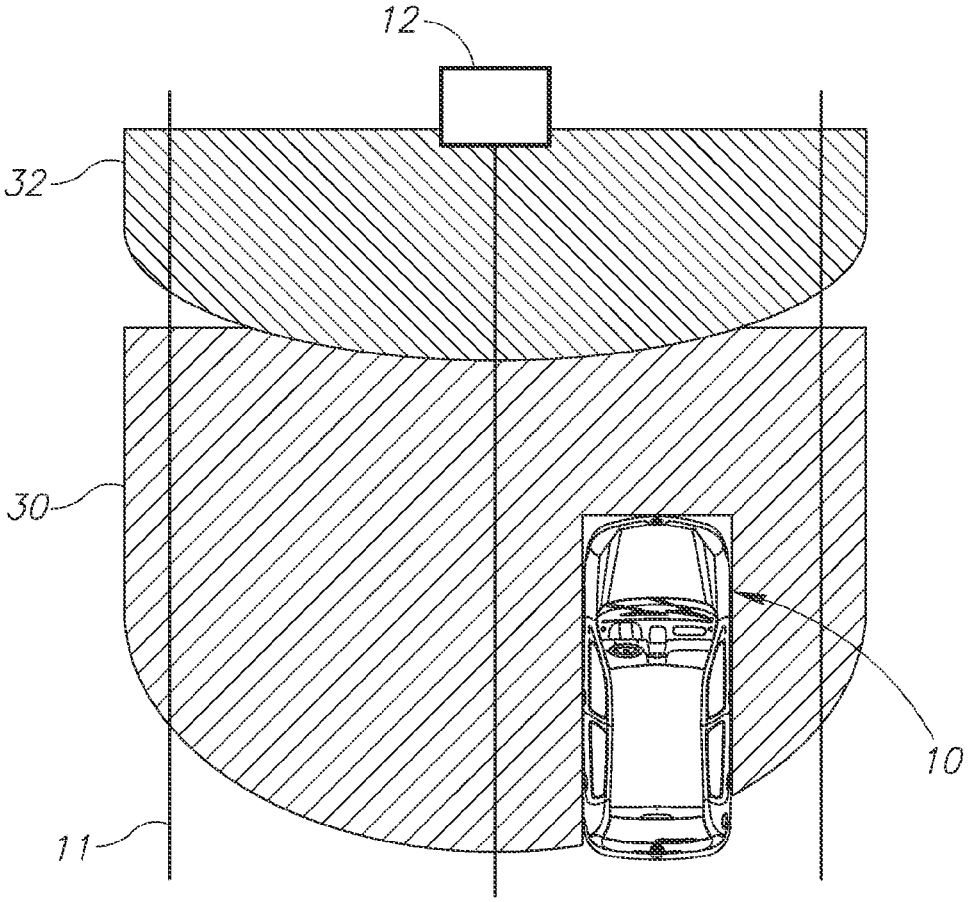
FIG. 3 is a top view of an adaptive traffic light with two different light signals' field of illumination in accordance with some embodiments of the present invention.

FIG. 2 and FIG. 3 illustrates two different illuminations zones (30 and 32) provided by adaptive traffic light 12. A vehicle 10 is approaching/heading upon a path/route 11 towards adaptive traffic light 12. In illumination zone 30 a motorist in vehicle 10 in this zone (30), observes a traffic light signal of a certain type (for example a red light) whereas at the same time illumination zone 32 a motorist in vehicle 10 in this zone (32), observes a traffic light signal of a different type as to the first light signal type (for example a green light). Each illumination zone (30 or 32) may have a different field of illumination (31 or 33 respectively).

Adaptive traffic light 12 may have at least a single illumination zone and may even provide more than two illumination zones.

Figure 4:
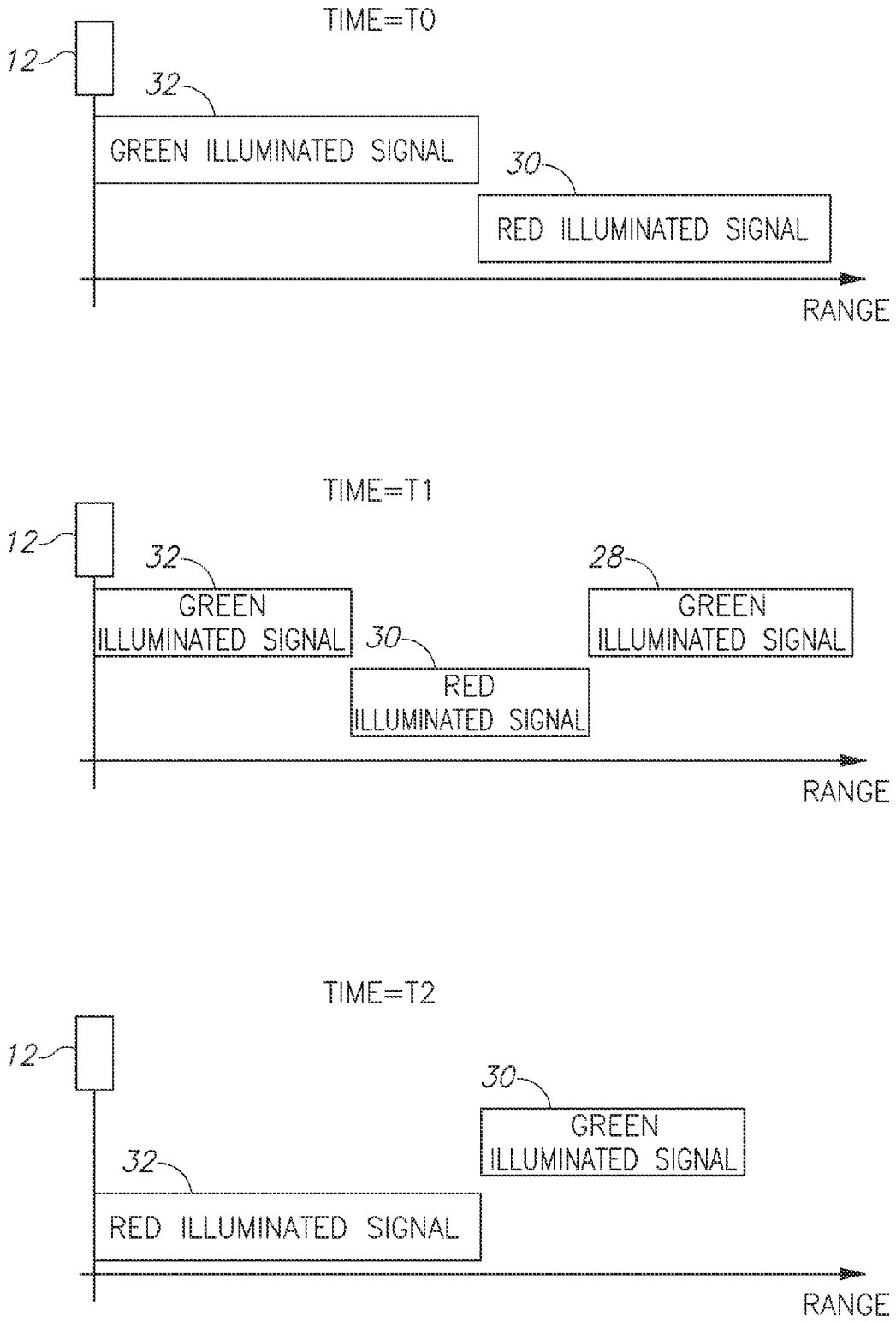
FIG. 4 describes an adaptive traffic light with two/three different light signals' field of illumination as a function of distance and timing in accordance with some embodiments of the present invention.

FIG. 4 illustrates two and three discrete and different illuminations zones (30, 32 and 28) provided by adaptive traffic light 12 in three different time sequences (T0>T1>T2). At T0 sequence (state) two fields of illuminations; a close range field 32 providing a green light signal and a far range field 30 providing a red light signal. In this time sequence (state) a motorist in the close range illuminated zone 32 observes only this signal whereas in the same time a motorist in the far range illuminated zone 30 observes only the red signal. At T2 sequence (state) three fields of illuminations; a close range field 32 providing a green light signal, a mid-range field 30 providing a red light signal and a far range field 28 providing a green light signal. In this time sequence (state) a motorist in the close or far range illuminated zone (32 and 28 respectively) observes only this signal whereas in the same time a motorist in the far range illuminated zone 30 observes only the red signal. At T3 sequence (state) two fields of illuminations; a close range field 32 providing a red light signal and a far range field 30 providing a green light signal. In this time sequence (state) a motorist in the close range illuminated zone 32 observes only this signal whereas in the same time a motorist in the far range illuminated zone 30 observes only the green signal.

Adaptive traffic light 12 fields of illumination zones may be discrete (i.e. fixed as to observer heading to the adaptive traffic light) or may be constantly changing through time (i.e. each field of illumination sector may change as a function of geometrically and/or change as a function of time).

Illumination zones (e.g. 30 and 32 as described in FIG. 2-FIG. 3) provided by adaptive traffic light 12 may be affected by predefined parameters comprising at least one: road allowed vehicle speed in the premises, actual vehicle speed (measured by a sensing unit such as a camera device), road layout, road condition, road topography, weather conditions, and traffic density with regard to traffic light signals timing and geometrical location. The allowed vehicle speed in the adaptive traffic light 12 premises may affect illumination zones (e.g. a 50 km per-hour location requires a shorter vehicle stopping distance versus a 30 km per-hour location). Weather condition may affect vehicle stopping distance (e.g. rain may increase vehicle stopping distance various dry road conditions). In such a scenario adaptive traffic light 12 may automatically adjust illumination zones to provide motorists a safe stopping distance as related to traffic light signaling status. Traffic light signals timing may affect illumination zones (e.g. a red light signal is about to be lit in 5 sec may require; a red illuminated zone for approaching vehicles above 100 m to decrease vehicle velocity whereas a green illuminated zone for approaching vehicles less than 100 m). Adaptive traffic light 12 location geometrical impact may affect illumination zones such as traffic light height, motorists viewing angles, road conditions etc.

According to some embodiments of the present invention, Adaptive traffic light 12 may further include means for obtaining road characteristics indicative of physical properties and topography of the road near the traffic light and updating the lighting pattern accordingly. Adaptive traffic light 12 may also obtain traffic regulatory data indicative of traffic regulations in force near the traffic light and updating the lighting pattern accordingly. Additionally, a control center (or controller) controlling adaptive traffic light 12 may also be configured to repeatedly update the lighting pattern based on parameters changing over time relating to the traffic near the traffic light.

Figure 5:
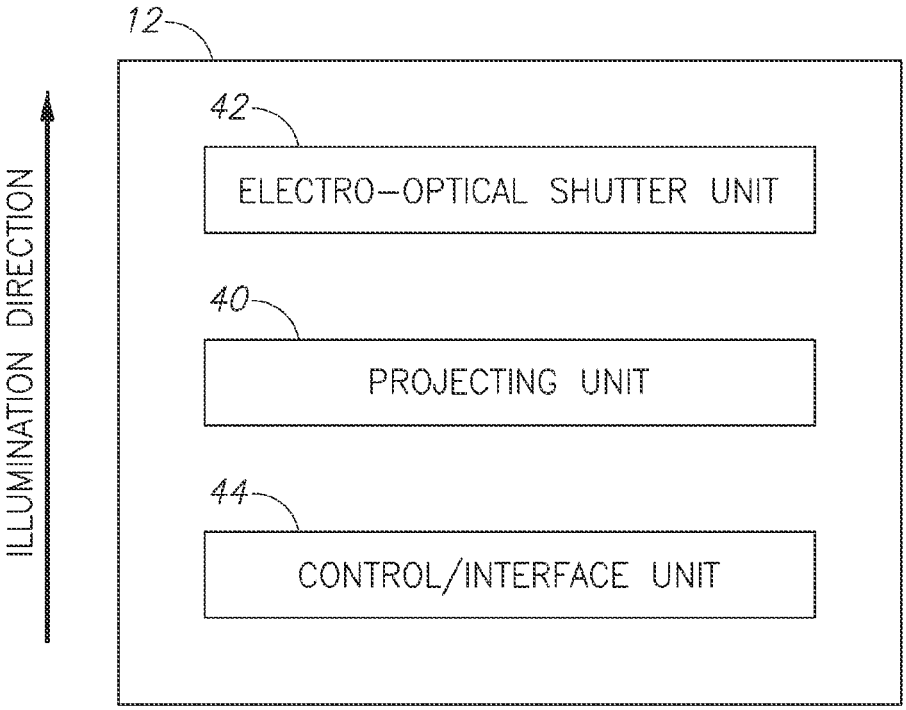
FIG. 5 and FIG. 6 describe adaptive traffic light configurations in accordance with some embodiments of the present invention.

A preferred method of implementation can be by introducing an electro-optical shutter unit 42 in front the projecting unit 40 as described in FIG. 5. Electro-optical shutter unit 42 may be; a Micro Electro Mechanical System (MEMS) such as: a Digital Micro-mirror Device (DMD), an optical modulator using Pockels effect, an optical modulator using Kerr effect, an optical shutter using a solid state material (e.g. GaAs etc.), an optical shutter using a Liquid Crystal Display (LCD), an optical shutter using polarization etc. Optical elements may be coupled with the electro-optical shutter unit 42 such as: folding elements, total internal reflection prisms, Fresnel optics, polarizers etc. Projecting unit 40 is configured to provide the traffic light signals (red, green and yellow if required). Projecting unit 40 illumination signals may be provided by; light bulbs, Light Emitting Diodes (LED), Laser or any other method of illumination. In the preferred method the illuminating elements are fixed (i.e. static) in the projecting unit 40 whereas the illumination zones (e.g. 30 and 32 as described in FIG. 2-FIG. 3) are controlled/shaped by the electro-optical shutter unit 42. Control/Interface unit 44 provides all require connections (e.g. mechanical, electrical etc.) to traffic light and manages/controls the adaptive traffic light 12.

Figure 6:
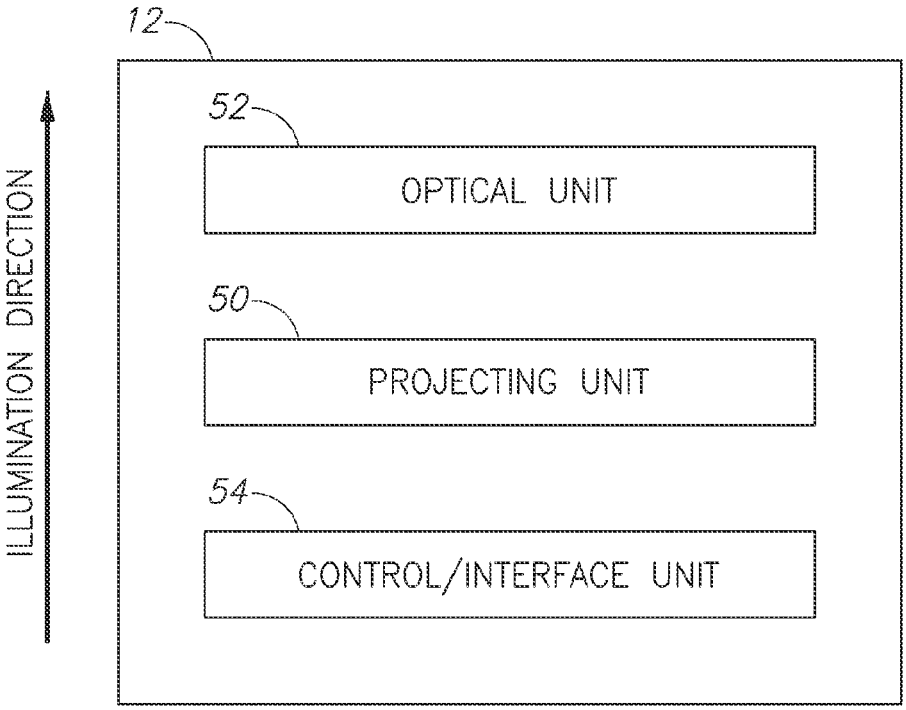

In one variant of the preferred exemplary embodiment, an optical unit 52 is located in front the projecting unit 50 as described in FIG. 6. Optical unit 52 may include; a Fresnel optical system, Fresnel lenses, standard optical system (i.e. concave and convex set of lenses) or any other method of providing the controllable fields of illumination (e.g. 31 and 33 as described in FIG. 2). Projecting unit 50 is configured to provide the traffic light signals (red, green and yellow if required). Projecting unit 50 illumination signals may be provided by; light bulbs, Light Emitting Diodes (LED), Laser or any other method of illumination. In this preferred method the optical unit 50 is fixed (i.e. static) whereas the illumination zones (e.g. 30 and 32 as described in FIG. 2-FIG. 3) are controlled/shaped by the projecting unit 50. Control/Interface unit 54 provides all require connections (e.g. mechanical, electrical etc.) to traffic light and manages/controls the adaptive traffic light 12.

Figure 7:
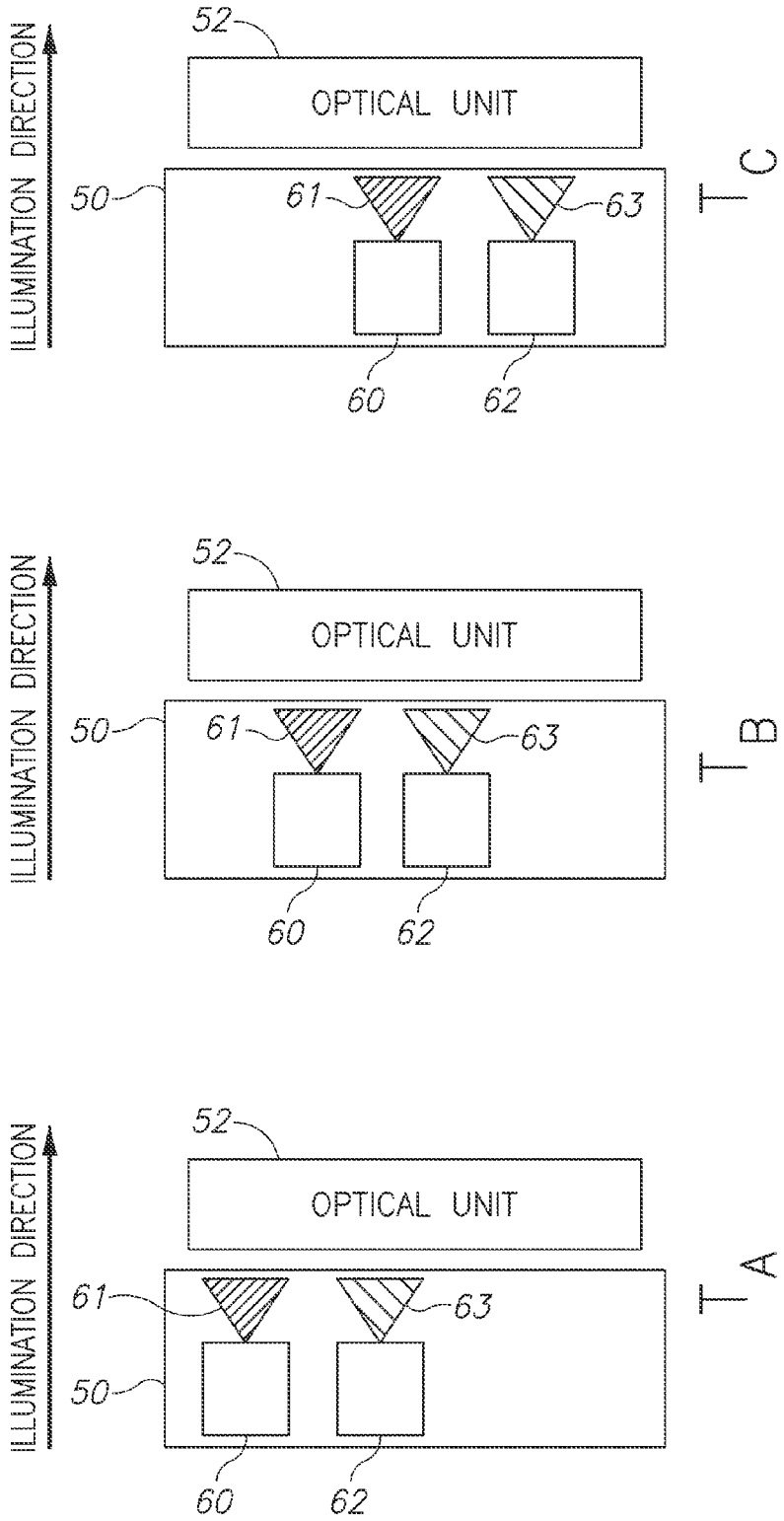
FIG. 7 describes an adaptive traffic light configuration as a function of time (state) in accordance with some embodiments of the present invention.

FIG. 7 further describes a preferred embodiment of providing controllable/shaped illumination zones (e.g. 30 and 32 as described in FIG. 2-FIG. 3) by projecting unit 50. Projecting unit 50 may consist of at least a single illuminating unit (e.g. an illuminating unit providing a traffic light red signal). Returning to FIG. 7, a general timing sequence is provided (TA<TB<TC) with a projecting unit 50 consisting two different illuminating units (60 and 62). Each illuminating unit may provide a different traffic light signal (e.g. illuminating unit 60 provides a signal 61 such as a red light signal while illuminating unit 62 provides a signal 63 such as a green light signal). Between time sequence TA, TB and TC illuminating units (60 and 62) are positioned in different locations in projecting unit 50 as to optical unit 52 (i.e. vertically allocated). These different locations provide the required illumination zones (e.g. 30 and 32 as described in FIG. 2-FIG. 3). Changing each illuminating unit (60 and 62) position may be done by; electro-mechanical means, a controllable light emitting array (e.g. a LED or laser array where a sub-cluster of the light emitting array is addressed/lit in each time).

In one variant of the preferred exemplary embodiment, each light emitting element of the light emitting array has a Fresnel lens.

Figure 8:
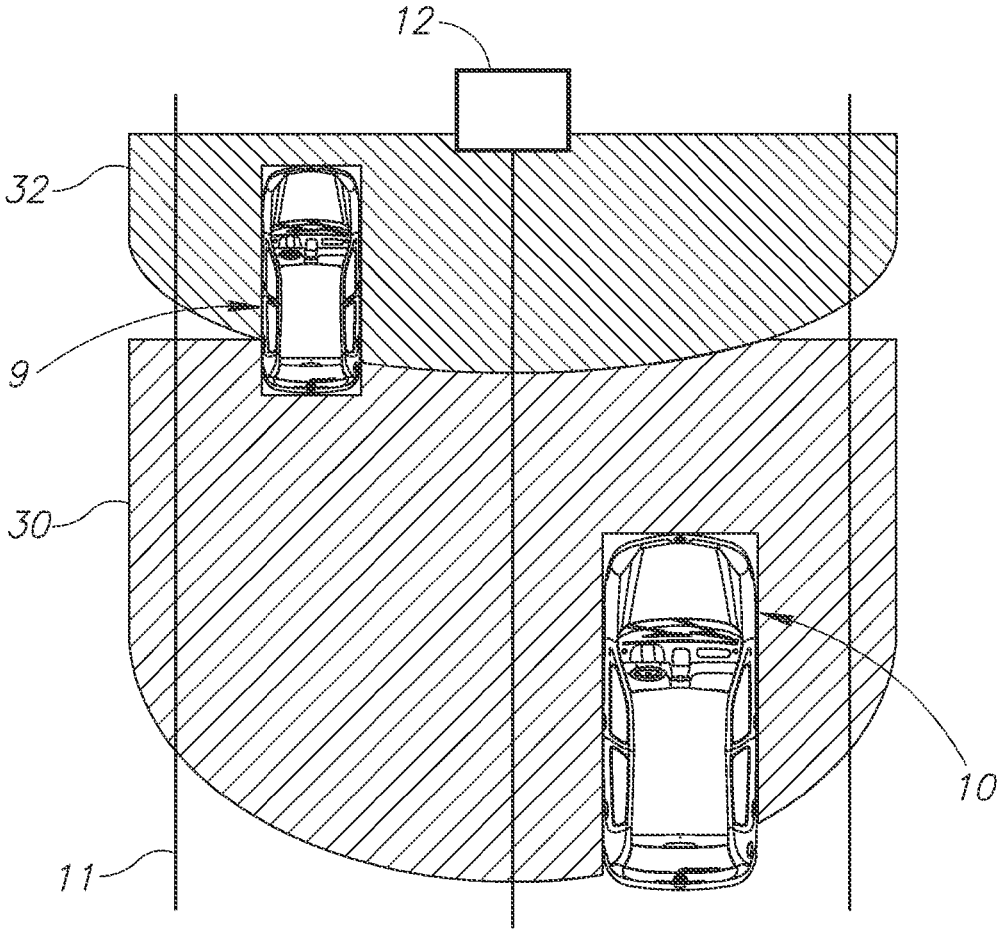
FIG. 8 is a top view of an adaptive traffic light with different light signals' field of illumination in accordance with some embodiments of the present invention.

In other embodiments of the present invention the use of different lighting pattern may include more than one distinguishable light signal in one distance range. referring to FIG. 8 the traffic light in this example is green while in the traditional way all drivers watching the traffic light would have seen green in this embodiment of the present invention it is possible to apply different lighting pattern to different distance range, the driver of vehicle 9 in region 32 would see a constant green light 26 while at the same time driver of vehicle 10 in region 30 would see constant green light 26 and a blinking red light 22 indicating that in his current distance and speed he will reach the traffic light 12 in red state. Other combinations and different logics are available and may be implemented according to different regulatory definitions.

While the invention has been described with respect to a limited number of embodiments, these should not be construed as limitations on the scope of the invention, but rather as exemplifications of some of the preferred embodiments. Other possible variations, modifications, and applications are also within the scope of the invention.

The invention claimed is:

1. A method of controlling a traffic light for vehicles at a junction, the traffic light having at least two distinguishable light signals, said method comprising:

obtaining a lighting pattern of the traffic light that determines an order of turning "on" and turning "off" said light signals of the traffic light from a proceed signal to a stop signal at fixed or variable intervals over time;

illuminating the light signals by at least one illuminator associated with the traffic light, based on the lighting pattern, such that over at least one period of time, a first light of the at least two distinguishable light signals is visible from a first distance range from the traffic light and a second light of the at least two distinguishable light signals is visible from a second distance range from the traffic light; and repeatedly updating the lighting pattern based on parameters changing over time relating to the traffic near the traffic light, wherein the first and the second distance ranges are non-overlapping, and wherein the first and the second distance ranges are determined and are repeatedly updated according to estimated stopping distances of the vehicles with respect to the junction for given road characteristics and/or traffic regulations.

2. The method according to claim 1, further comprising obtaining road characteristics indicative of physical properties and topography of the road near the traffic light and updating the lighting pattern accordingly.

3. The method according to claim 1, further comprising obtaining traffic regulatory data indicative of traffic regulations in force near the traffic light and updating the lighting pattern accordingly.

4. The method according to claim 2, wherein the road characteristics comprise at least one: road allowed vehicle speed in the premises, actual vehicle speed, road layout, road condition, road topography, weather conditions, and traffic density.

5. The method according to claim 3, wherein the traffic regulatory data comprise at least one of: upper limit of speed, right of way near the traffic light, and number of lanes per road.

6. The method according to claim 1, wherein the first light signal is green and the second light signal is red.

7. The method according to claim 1, wherein the lighting pattern includes at least one period of time in which the different ranges include three ranges wherein the ranges which are nearer and farther from the traffic light are of the first light signal and wherein the ranges that is between the two other ranges is of the second light signal.

8. The method according to claim 1, comprising obtaining a lighting pattern of the traffic light that determines an order of turning "on" and turning "off" said light signals of the traffic light from a proceed signal to a change status signal, to a stop signal at fixed or variable intervals over time.

9. The method of claim 1, further comprising sensing at least one of the parameters by at least one traffic sensor mounted on the traffic light and updating the lighting pattern responsively.

10. A system for controlling a traffic light for vehicles at a junction, the traffic light having at least two distinguishable light signals, said system comprising:

a controller configured to obtain a lighting pattern of the traffic light that determines an order of turning "on" and turning "off" said light signals of the traffic light from a proceed signal to a stop signal at fixed or variable intervals over time;

an array of range-controlled illuminators associated with the traffic light, configured to illuminate the light signals based on the lighting pattern, such that over at least one period of time, a first light of the at least two distinguishable light signals is visible from a first distance range from the traffic light and a second light of the at least two distinguishable light signals is visible from a second distance range from the traffic light; wherein the controller is further configured to repeatedly update the lighting pattern based on parameters changing over time relating to the traffic near the traffic light, wherein the first and the second distance ranges are non-overlapping, and wherein the first and the second distance ranges are determined and the lighting pattern is repeatedly updated according to estimated stopping distances of the vehicles with respect to the junction for given road characteristics and/or traffic regulations.

11. The system according to claim 10, wherein the controller is further configured to obtain road characteristics indicative of physical properties and topography of the road near the traffic light and updating the lighting pattern accordingly.

12. The system according to claim 10, the controller is further configured to obtain traffic regulatory data indicative of traffic regulations in force near the traffic light and updating the lighting pattern accordingly.

13. The system according to claim 11, wherein the road characteristics comprise at least one: road allowed vehicle speed in the premises, actual vehicle speed, road layout, road condition, road topography, weather conditions, and traffic density.

14. The system according to claim 12, wherein the traffic regulatory data comprise at least one of: upper limit of speed, right of way near the traffic light, and number of lanes per road.

15. The system according to claim 10, wherein the first light signal is green and the second light signal is red.

16. The system according to claim 10, wherein the lighting pattern includes at least one period of time in which the different ranges include three ranges wherein the ranges which are nearer and farther from the traffic light are of the first light signal and wherein the ranges that is between the two other ranges is of the second light signal.

17. The system according to claim 10, wherein the controller is configured to obtain a lighting pattern of the traffic light that determines an order of turning "on" and turning "off" said light signals of the traffic light from a proceed signal to a change status signal, to a stop signal at fixed or variable intervals over time.

18. A method of controlling a traffic light for vehicles at a junction, the traffic light having at least three distinguishable light signals, said method comprising:

obtaining a lighting pattern of the traffic light that determines an order of turning "on" and turning "off" said light signals of the traffic light over time;

illuminating the light signals by at least one illuminator associated with the traffic light, based on the lighting pattern, such that over at least one period of time, a first light of the at least three distinguishable light signals is visible from a first distance range from the traffic light, a second light of the at least three distinguishable light signals is visible from a second distance range from the traffic light and a third light of the at least three distinguishable light signals is visible from a third distance range from the traffic light; and repeatedly updating the lighting pattern based on parameters changing over time relating to the traffic near the traffic light, wherein the first, the second and the third distance ranges are non-overlapping, and wherein the first, the second and the third distance ranges are determined and are repeatedly updated according to estimated stopping distances of the vehicles with respect to the junction for given road characteristics and/or traffic regulations.

19. The method of claim 18, further comprising sensing at least one of the parameters by at least one traffic sensor mounted on the traffic light and updating the lighting pattern responsively.

20. The system of claim 10, further comprising at least one traffic sensor mounted on the traffic light and configured to sense at least one of the parameters, and wherein the controller is further configured to receive the sensed at least one of the parameters from the at least one traffic sensor and update the lighting pattern responsively.

* * * * *